US009451807B2

(12) United States Patent
Snider-Tornetta et al.

(10) Patent No.: US 9,451,807 B2
(45) Date of Patent: Sep. 27, 2016

(54) PEDICURE PROTECTOR FOR USE BEFORE, DURING AND/OR AFTER A PEDICURE AND METHOD OF USING SAME

(76) Inventors: Jennifer Snider-Tornetta, Sayreville, NJ (US); Charles Frank Tornetta, Sayreville, NJ (US)

( * ) Notice: Subject to any disclaimer, the term of this patent is extended or adjusted under 35 U.S.C. 154(b) by 903 days.

(21) Appl. No.: 13/196,473

(22) Filed: Aug. 2, 2011

(65) Prior Publication Data

US 2012/0030866 A1 Feb. 9, 2012

Related U.S. Application Data

(60) Provisional application No. 61/370,886, filed on Aug. 5, 2010.

(51) Int. Cl.

| | |
|---|---|
| ***A43B 23/08*** | (2006.01) |
| ***A43B 7/32*** | (2006.01) |
| ***A43C 13/14*** | (2006.01) |
| ***A43B 1/00*** | (2006.01) |
| ***A43B 3/24*** | (2006.01) |
| ***A43B 7/06*** | (2006.01) |
| ***A43B 7/08*** | (2006.01) |
| ***A43B 7/26*** | (2006.01) |

(52) U.S. Cl.

CPC ..... *A43B 23/087* (2013.01); *A43B 1/0054* (2013.01); *A43B 1/0081* (2013.01); *A43B 3/242* (2013.01); *A43B 7/06* (2013.01); *A43B 7/085* (2013.01); *A43B 7/26* (2013.01)

(58) Field of Classification Search

CPC ..... A41D 13/06; A43B 7/06; A43B 7/085; A43B 7/26; A43B 3/242; A43B 1/0054; A43B 1/0081; A43B 23/087

USPC ..... 2/455

See application file for complete search history.

(56) References Cited

U.S. PATENT DOCUMENTS

| | | | | |
|---|---|---|---|---|
| 4,177,583 | A * | 12/1979 | Chapman | 36/77 R |
| 4,439,935 | A * | 4/1984 | Kelly | 36/101 |
| 5,623,734 | A | 4/1997 | Pugliatti | |
| 5,906,007 | A | 5/1999 | Roberts | |
| 5,946,823 | A * | 9/1999 | Yates | 36/11.5 |
| 6,415,795 | B1 | 7/2002 | Kew | |
| 6,704,941 | B1 * | 3/2004 | Palm | 2/239 |
| 7,134,225 | B2 * | 11/2006 | Ashton | 36/94 |
| 7,296,367 | B2 * | 11/2007 | Kipnes | 36/94 |
| 7,685,746 | B2 * | 3/2010 | Kipnes et al. | 36/94 |
| 2007/0011915 | A1 * | 1/2007 | Allen | 36/94 |
| 2007/0068045 | A1 * | 3/2007 | Condie | 36/101 |
| 2008/0098623 | A1 * | 5/2008 | Komitau | 36/101 |

* cited by examiner

*Primary Examiner* — Clinton T Ostrup
*Assistant Examiner* — Jameson Collier
(74) *Attorney, Agent, or Firm* — Chip Law Group

(57) ABSTRACT

Certain embodiments provide pedicure protectors and methods for preventing polished toenails from smudging, smearing and/or otherwise being damaged. The pedicure protector may include a main body for receiving toes and ball of a foot. The main body may include a plurality of toe loop separators for wrapping around individual toes to align, separate and inhibit upward movement of toes. The pedicure protector may also include an upper surface that is repeatedly detachable and attachable to the main body. The upper surface may include at least one ventilation hole.

21 Claims, 5 Drawing Sheets

PEDICURE PROTECTOR FOR USE BEFORE, DURING AND/OR AFTER A PEDICURE AND METHOD OF USING SAME

CROSS-REFERENCE TO RELATED APPLICATIONS/INCORPORATION BY REFERENCE

The present application claims priority under 35 U.S.C. §119(e) to provisional application Ser. No. 61/370,886, filed on Aug. 5, 2010.

The above referenced provisional application is hereby incorporated herein by reference in its entirety.

FEDERALLY SPONSORED RESEARCH OR DEVELOPMENT

[Not Applicable]

MICROFICHE/COPYRIGHT REFERENCE

[Not Applicable]

FIELD OF THE INVENTION

Certain embodiments of the invention relate to pedicure protection. More specifically, certain embodiments of the invention relate to pedicure protectors and methods for preventing polished toenails from smudging, smearing and/or otherwise being damaged.

BACKGROUND OF THE INVENTION

Pedicures, including the application of toenail polish, are a popular manner for improving the health and cosmetic appearance of feet. Many people spend a significant amount of time and expense on a regular basis cosmetically improving the appearance of their feet by frequenting spas, salons and/or performing in-home pedicures. Once toenail polish is applied, it may take hours for the polish to fully dry. As such, individuals with pedicures often find it difficult to move about, perform various tasks, or even go to bed without damaging recently applied toenail polish. Due to the time and expense of having toenails polished, it is frustrating when recently polished toenails are smudged, smeared or otherwise damaged.

Further, damage to recently polished toenails typically occurs when the polished toenails contact other items. Thus, in addition to damaging the recently polished toenails, the contacted items may also be damaged by the toenail polish, which may be difficult if not impossible to remove from contacted items without damaging the contacted items. For example, if an individual with recently applied toenail polish attempts to go to bed prior to the toenail polish fully drying, the toenail polish as well as any sheets, comforters and/or other bedding that comes in contact with the toenail polish may be damaged.

Further limitations and disadvantages of conventional and traditional approaches will become apparent to one of skill in the art, through comparison of such systems with some aspects of the present invention as set forth in the remainder of the present application with reference to the drawings.

BRIEF SUMMARY OF THE INVENTION

An apparatus and/or method is provided for pedicure protectors, substantially as shown in and/or described in connection with at least one of the figures, as set forth more completely in the claims.

These and other advantages, aspects and novel features of the present invention, as well as details of an illustrated embodiment thereof, will be more fully understood from the following description and drawings.

DETAILED DESCRIPTION

Certain embodiments of the invention may be found in a method and apparatus comprising pedicure protectors for preventing polished toenails from smudging, smearing and/or otherwise being damaged. In various embodiments of the invention, a pedicure protector is provided that comprises a main body and an upper surface that is repeatedly detachable and attachable to the main body. The main body is operable to receive the toes and ball of a foot and comprises a plurality of toe loop separators for wrapping around individual toes to align, separate and inhibit upward movement of the toes. The upper surface comprises one or more ventilation holes. The upper surface may be more rigid than the main body.

In certain embodiments of the invention, the upper surface may comprise a plurality of extrusion edges. An inner surface of each of the plurality of extrusion edges may be affixed with at least one attachment. The main body may comprise a plurality of cut out sections that correspond with the plurality of extrusion edges of the upper surface when the upper surface is attached to the main body. Each of the plurality of cut out sections may be affixed with at least one attachment. The at least one attachment may comprise one or more of a magnet, a hook and loop fastener, and a snap.

The upper surface may comprise a front section and a back section. The front section of the upper surface may be tapered such that there is more height at a front of the front section and less height where the front section meets the back section. The back section of the upper surface may be tapered such that there is less height where the back section meets the front section and more height at a rear portion of the back section.

In various embodiments of the invention, the at least one ventilation hole is provided at the back section of the upper surface.

The main body may receive toes and the ball of the foot at a top side of the main body. Further, a bottom side of the main body may comprise one or more of a rough surface, and a grooved surface.

In certain embodiments of the invention, the plurality of toe loop separators each includes a length, diameter, circumference and possesses elastic properties.

Figure 1:
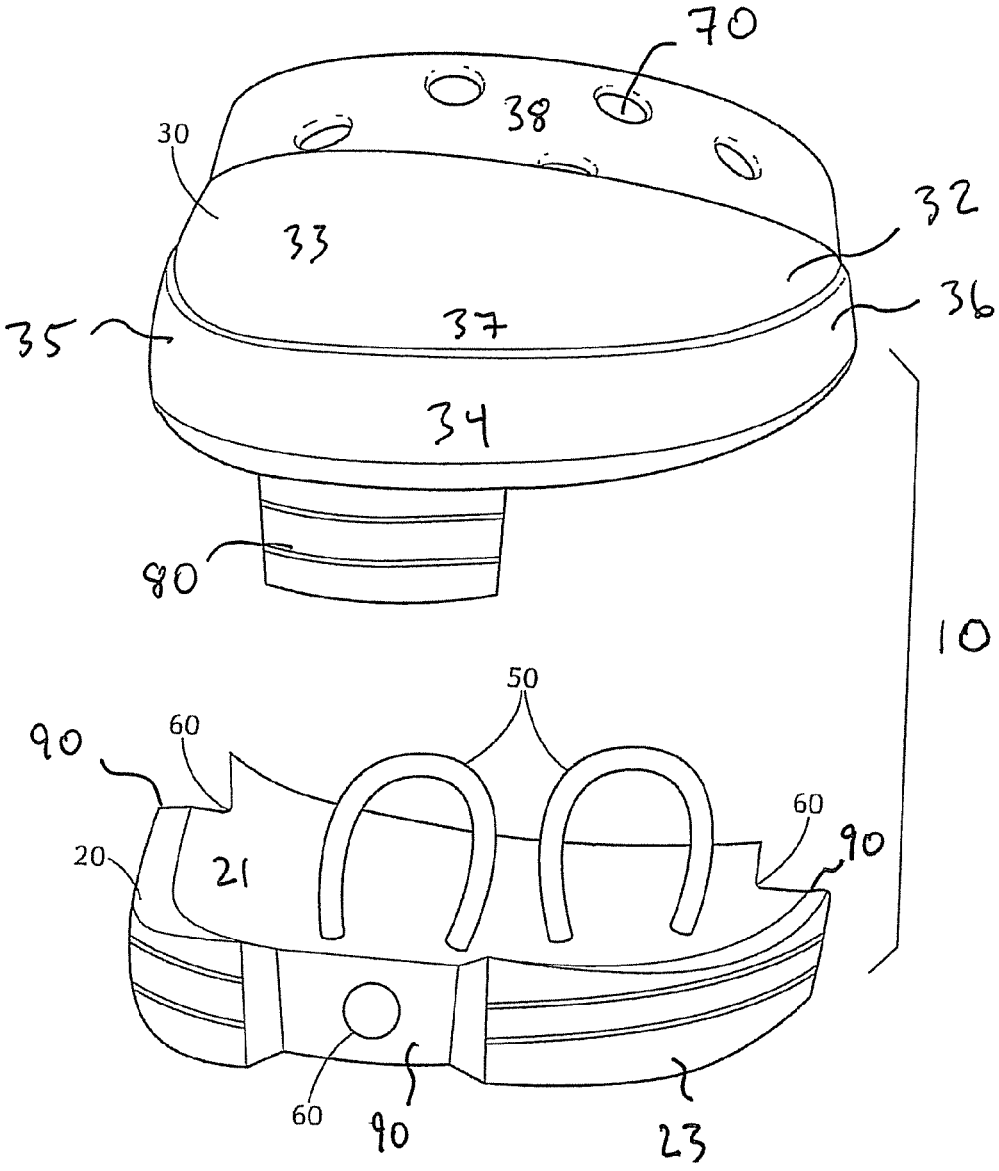
FIG. 1 is a diagram that illustrates a front view of an exemplary pedicure protector main body detached from a repeatedly attachable and detachable upper surface in accordance with an embodiment of the present invention.

FIG. 1 is a diagram that illustrates a front view of an exemplary pedicure protector 10 main body 20 detached from a repeatedly attachable and detachable upper surface 30 in accordance with an embodiment of the present invention. Referring to FIG. 1, there is shown a pedicure protector 10. The pedicure protector 10 may comprise a main body 20 and an upper surface 30.

The pedicure protector 10 may be made of foam, foam resin, plastic, or any other suitable lightweight and semi-rigid material.

The main body 20 of the pedicure protector 10 may comprise material that is less rigid than the upper surface 30. When the pedicure protector 10 is worn, the main body 20 may be operable to flex or bend while the upper surface 30 remains more rigid.

The upper surface 30 may comprise a material that may be more rigid than a material that is utilized for the main body 20. The upper surface 30 may be more rigid than the main body 20. This may allow the pedicure protector to bend and flex when it is being worn.

In certain embodiments of the invention, the upper surface 30 may be repeatedly attachable and detachable to the main body 20 and protects recently applied toenail polish from being smudged, smeared or otherwise damaged by coming in contact with other items. The upper surface 30 may include a top of foot side 33, a front of foot side 34, an inner foot side 35, and an outer foot side 36, for example. Further, the upper surface 30 may include an inner surface 31 (as illustrated, for example, in FIG. 4) and an outer surface 32. The upper surface 30 may also comprise a front section 37 towards the end of a wearer's toes and a back section 38 towards the ball of a wearer's foot. Additionally, the upper surface 30 may include extrusion edges 80 that may, in certain embodiments, extend from front of foot side 34 (as illustrated, for example, in FIG. 1) and/or from one or both of the inner foot side 35 and outer foot side 36 (as illustrated, for example, in FIGS. 4-5).

The front of foot side 34, inner foot side 35, and outer foot side 36 of the upper surface 30 may be a sufficient height such that a wearer's flexed toes would not be capable of contacting the inner surface 31 of the top of foot side 33 of the upper surface 30. The front section 37 of the upper surface 30 may be tapered such that there is more height towards the end of a wearer's toes (i.e., the front of the front section 37) and a lesser height where the front section 37 meets the back section 38 of the upper surface 30 for allowing additional room for a wearer to flex their toes without contacting the inner surface 31 of the upper surface 30. The back section 38 of the upper surface 30 may be tapered such that there is less height where the front section 37 meets the back section 38 and more height towards the ball of a wearer's foot (i.e., the rear portion of the back section 38) for a comfortable fit to the top of a wearer's foot at the ball of the wearer's foot (as illustrated, for example, in FIGS. 3 and 5).

In certain embodiments of the invention, the upper surface 30 may comprise one or more openings 70 for ventilation to permit toenail polish to dry. In certain embodiments, the ventilating holes 70 may be at the back section 38 of the upper surface 30 as illustrated in FIGS. 1-5. For example the ventilating holes 70 may be just above a point of inflection of a wearer's toes when the upper surface 30 is attached to the main body 20. In some embodiments of the invention, the ventilation holes 70 may be at the front section 37 of the upper surface 30 or at both the front section 37 and the back section 38 of the upper surface 30.

The upper surface 30 may further comprise one or more attachments 40 (as shown, for example, in FIG. 4) for attaching to one or more corresponding attachments 60 of the main body 20. The attachments 40 may be affixed to an inner surface of extrusion edges 80 of the upper surface 30 that mate with cut out sections 90 of main body 20. The attachments 40 may comprise magnets, hook and loop fasteners, snaps, or any other suitable securing closure corresponding to the attachments 60 of main body 20.

The main body 20 may be operable to receive and secure the toes and ball of a foot. When worn by a user, the main body 20 may extend from the ball of the foot to just beyond the toes. The main body 20 and upper surface 30 may be operable to cover the forefront and base of the toes and may conform to the contours of the foot to hold the toes in place comfortably and without irritation when worn by a user. The main body 20 may comprise a top side 21 for receiving the toes and a ball of a foot, a bottom side 22 (as illustrated, for example, in FIGS. 3 and 5), and a perimeter side 23. In certain embodiments, the bottom side 22 of the main body 20 may be a rough surface, grooved surface, or the like in order to improve traction when used by a wearer (as illustrated, for example, in FIGS. 3 and 5).

The perimeter side 23 of the main body 20 includes one or more attachments 60. The one or more attachments 60 may be affixed to cut out sections 90 in the perimeter side 23 of the main body 20 (as illustrated, for example, in FIGS. 1 and 5) and the cut out sections 90 may mate with extrusion edges 80 of the upper surface 30 (as illustrated, for example, in FIG. 3). The upper surface 30 may comprise corresponding attachments 40 affixed thereto such that the upper surface 30 is repeatedly detachable and attachable to the perimeter side 23 of the main body 20. The attachments 60 may include magnets, hook and loop fasteners, snaps, or any other suitable securing closure corresponding to the attachments 40 of upper surface 30.

The top side 21 of the main body may comprise toe loop separators 50. The toe loop separators 50 may be operable to comfortably wrap around the individual toes of a wearer to stabilize the foot, reduce and/or inhibit the vertical or horizontal movement of the toes to prevent the toes from coming in contact with the upper surface 30. In this regard, the toe loop separators 50 may reduce the range of flexion of a wearer's toes. In certain exemplary embodiments of the invention, two toe loop separators 50 are provided for wrapping around the second and fourth toes of a wearer such that each of the wearer's five toes are separated. In other exemplary embodiments of the invention, more or less toe loop separators 50 may be provided. The toe loop separators 50 may be operable to align and separate the toes and fit snugly between and around a wearer's toes. The toe loop separators 50 have a length, diameter and a circumference and may further possess elastic properties. Additionally, the elastic material allows the toe loops separators 50 to be positioned and maintained at numerous locations between the wearer's toes for customizable positioning between the toes.

Figure 2:
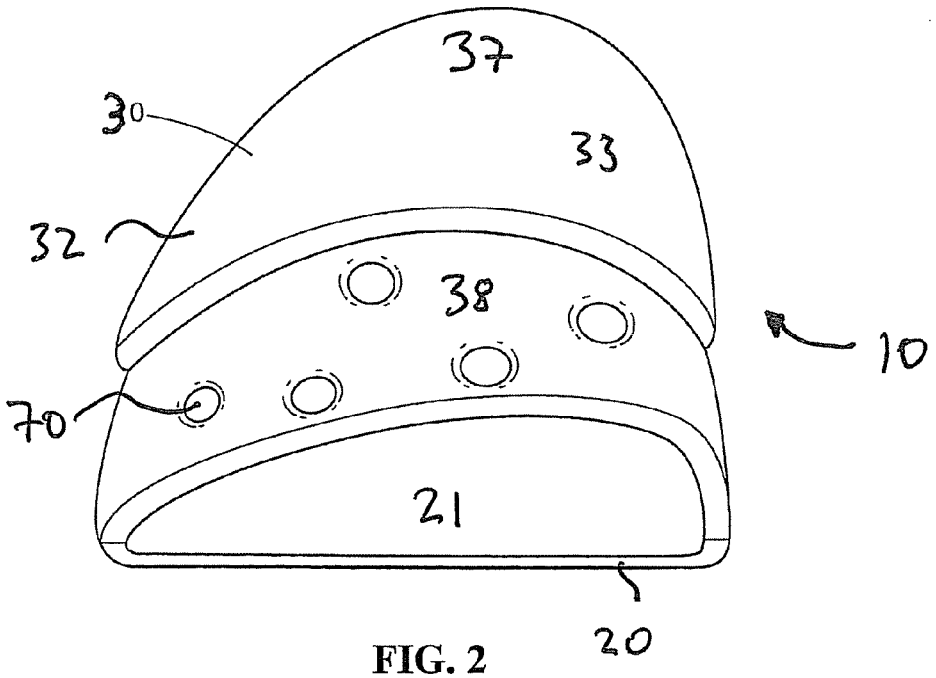
FIG. 2 is a diagram that illustrates a top view of an exemplary pedicure protector in accordance with an embodiment of the present invention.

FIG. 2 is a diagram that illustrates a top view of an exemplary pedicure protector in accordance with an embodiment of the present invention. Referring to FIG. 2, there is shown an upper surface 30 attached to a main body 20.

The main body 20 may comprise a top side 21 for receiving the toes and a ball of a foot.

The upper surface 30 may comprise an outer surface 32 having a top of foot side 33. The upper surface 30 may include a front section 37 and a back section 38. In certain embodiments of the invention, the upper surface 30 may comprise one or more openings 70 for ventilation to permit toenail polish to dry.

The pedicure protector 10 illustrated in FIG. 2 shares various characteristics with the pedicure protector 10 illustrated in FIG. 1 as described above.

Figure 3:
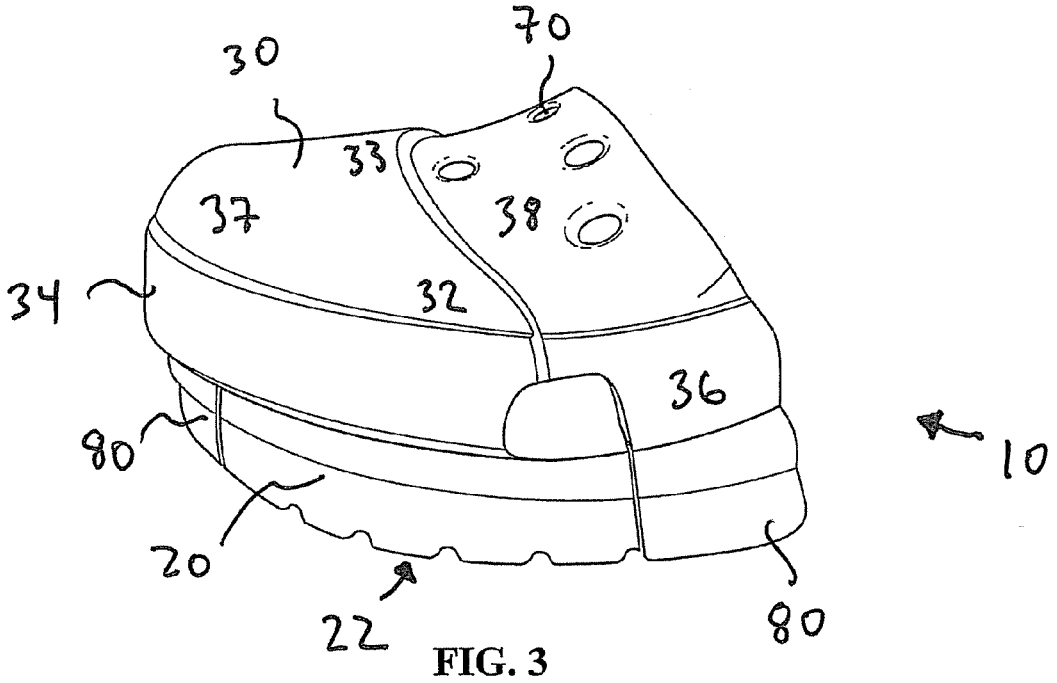
FIG. 3 is a diagram that illustrates a side view of an exemplary pedicure protector in accordance with an embodiment of the present invention.

FIG. 3 is a diagram that illustrates a side view of an exemplary pedicure protector in accordance with an embodiment of the present invention. Referring to FIG. 3, there is shown an upper surface 30 attached to a main body 20.

The upper surface 30 may comprise an outer surface 32 having a top of foot side 33, a front of foot side 34 and an outer foot side 36. The upper surface 30 may include a front section 37 and a back section 38. In certain embodiments of the invention, the upper surface 30 may comprise one or more openings 70 for ventilation to permit toenail polish to dry.

The pedicure protector 10 illustrated in FIG. 3 shares various characteristics with the pedicure protector 10 illustrated in FIGS. 1-2 as described above.

Figure 4:
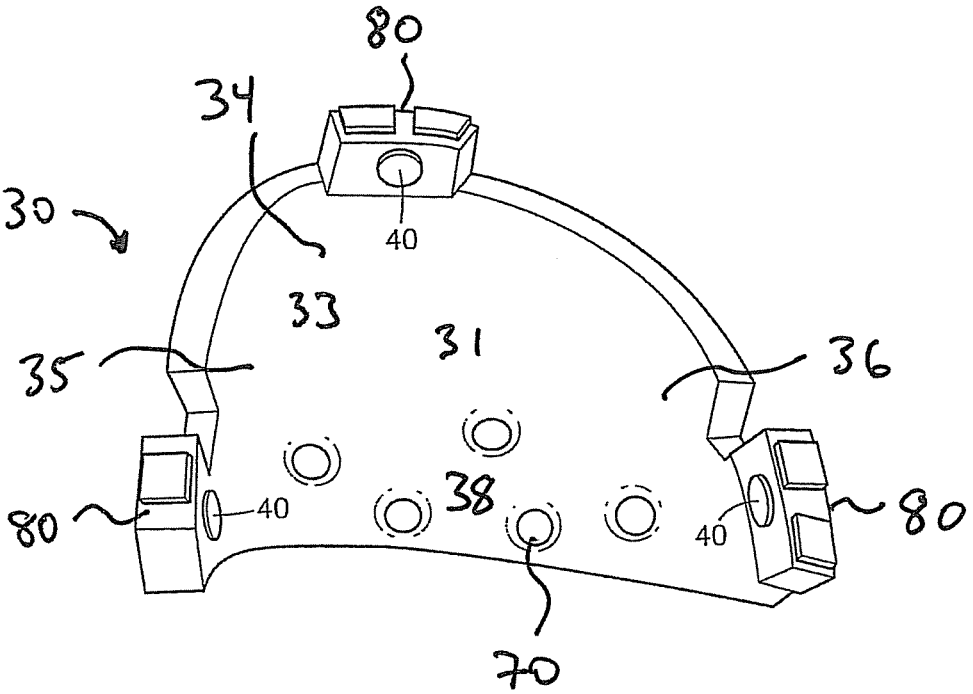
FIG. 4 is a diagram that illustrates an inner surface view of an exemplary repeatedly attachable and detachable upper surface of a pedicure protector in accordance with an embodiment of the present invention.

FIG. 4 is a diagram that illustrates an inner surface 31 view of an exemplary repeatedly attachable and detachable upper surface 30 of a pedicure protector 10 in accordance with an embodiment of the present invention. Referring to FIG. 4, there is shown an upper surface 30.

The upper surface 30 may comprise a top of foot side 33, a front of foot side 34, an inner foot side 35, and an outer foot side 36, for example. Further, the upper surface 30 may include an inner surface 31. The upper surface 30 may also comprise a front section 37 towards the end of a wearer's toes and a back section 38 towards the ball of a wearer's foot. Additionally, the upper surface 30 may comprise one or more openings 70 for ventilation to permit toenail polish to dry.

In certain embodiments of the invention, the upper surface 30 may include extrusion edges 80 that may, in certain embodiments, extend from front of foot side 34 and/or from one or both of the inner foot side 35 and outer foot side 36. The upper surface 30 may comprise one or more attachments 40 for attaching to one or more corresponding attachments 60 of the main body 20 (as shown, for example, in FIGS. 1 and 5). In certain embodiments of the invention, the attachments 40 may be affixed to an inner surface of extrusion edges 80 of the upper surface 30. The attachments 40 may comprise magnets, hook and loop fasteners, snaps, or any other suitable securing closure or fastener corresponding to the attachments 60 of main body 20.

The upper surface 30 illustrated in FIG. 4 shares various characteristics with the upper surface 30 illustrated in FIGS. 1-3 as described above.

Figure 5:
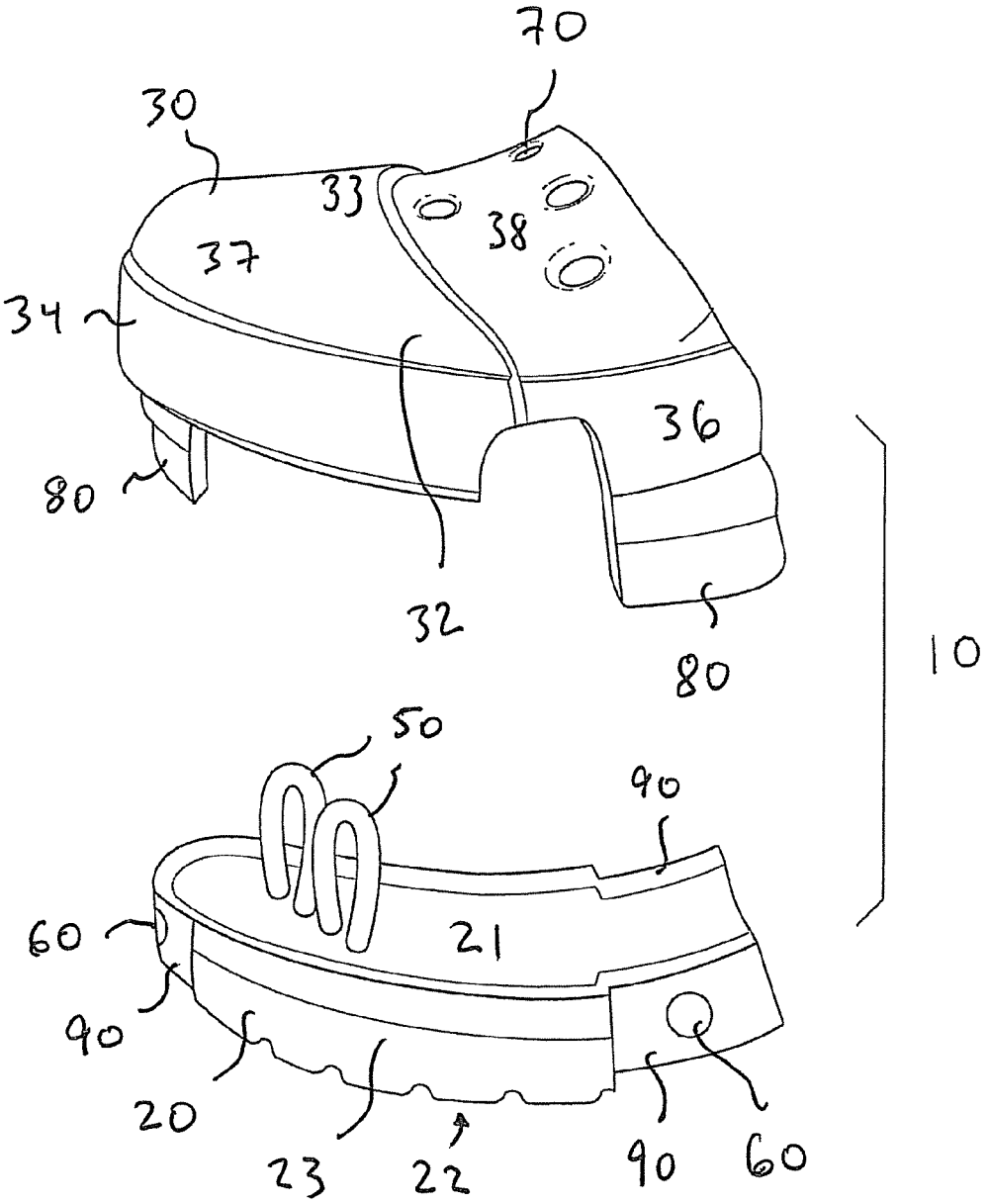
FIG. 5 is a diagram that illustrates a side view of an exemplary pedicure protector main body detached from a repeatedly attachable and detachable upper surface in accordance with an embodiment of the present invention.

FIG. 5 is a diagram that illustrates a side view of an exemplary pedicure protector main body detached from a repeatedly attachable and detachable upper surface in accordance with an embodiment of the present invention. Referring to FIG. 5, there is shown an upper surface 30 detached from a main body 20.

The main body 20 may comprise a top side 21 for receiving the toes and a ball of a foot, a bottom side 22, and a perimeter side 23. The perimeter side 23 of the main body 20 includes one or more attachments 60. The one or more attachments 60 may be affixed to cut out sections 90 in the perimeter side 23 of the main body 20 and the cut out sections 90 may mate with extrusion edges 80 of the upper surface 30 (as illustrated, for example, in FIG. 3). The top side 21 of the main body may comprise toe loop separators 50 operable to comfortably wrap around the individual toes of a wearer to separate the toes, stabilize the foot, reduce and/or inhibit the vertical or horizontal movement of the toes to prevent the toes from coming in contact with each other and the upper surface 30. In this regard, the toe loop separators 50 may reduce the range of flexion of a wearer's toes.

The upper surface 30 may comprise a top of foot side 33, a front of foot side 34, and an outer foot side 36, for example. Further, the upper surface 30 may include an outer surface 32. The upper surface 30 may also include a front section 37 towards the end of a wearer's toes and a back section 38 towards the ball of a wearer's foot. Additionally, the upper surface 30 may include extrusion edges 80 that may, in certain embodiments, extend from the front of foot side 35 and outer foot side 36. In certain embodiments of the invention, the upper surface 30 may comprise one or more openings 70 for ventilation to permit toenail polish to dry.

The pedicure protector 10 illustrated in FIG. 5 shares various characteristics with the pedicure protector 10 illustrated in FIGS. 1-4 as described above.

Figure 6:
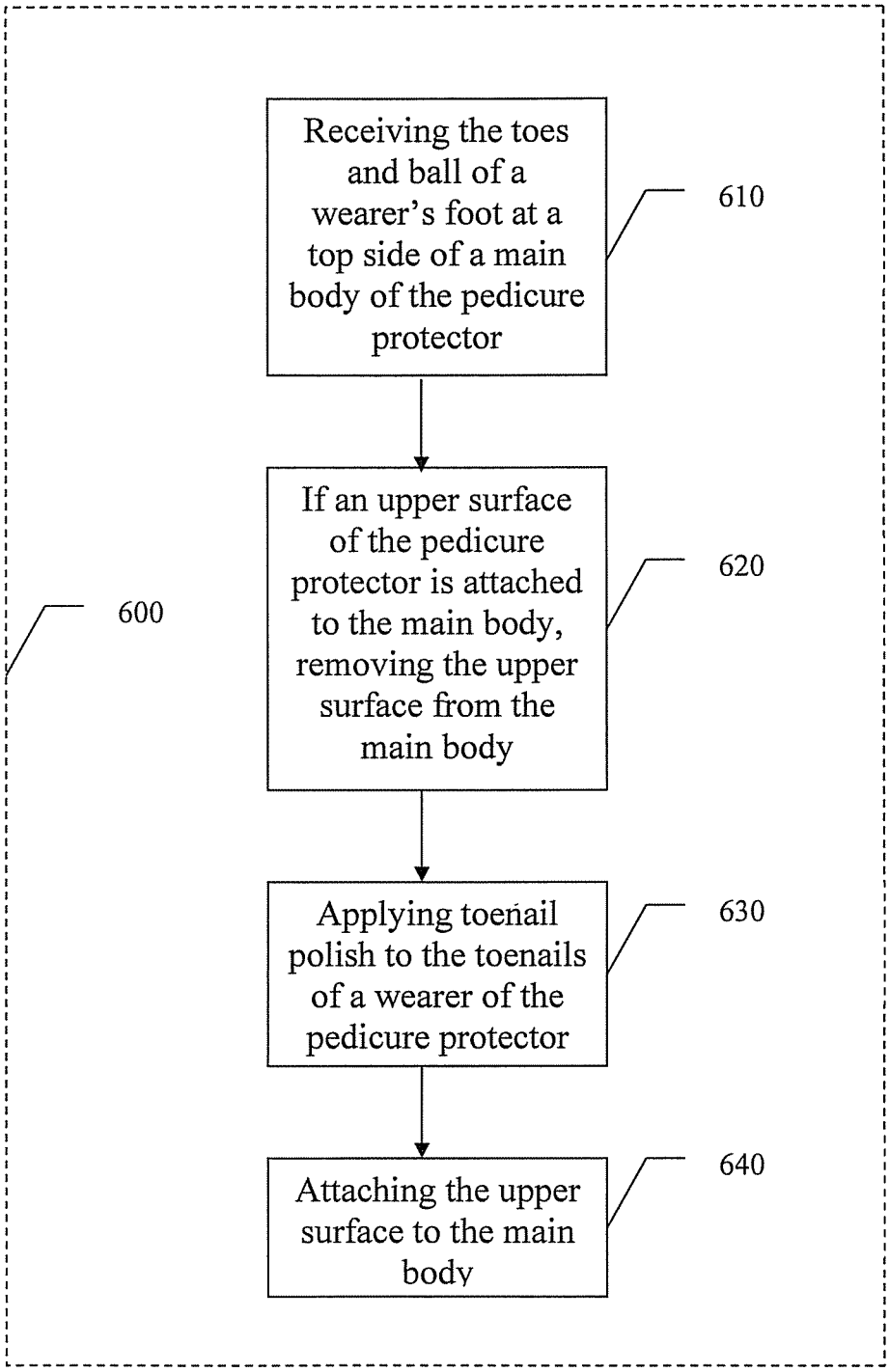
FIG. 6 is a flow diagram that illustrates exemplary steps for protecting pedicures in accordance with an embodiment of the present invention.

FIG. 6 is a flow diagram that illustrates exemplary steps for protecting pedicures in accordance with an embodiment of the present invention. Referring to FIG. 6, there is shown a flow diagram 600, which illustrates exemplary steps for protecting pedicures. At step 610, the toes and ball of a wearer's foot may be received at a top side 21 of a main body 20 of the pedicure protector 10. At step 620, if an upper surface 30 of the pedicure protector 10 is attached to the main body 20, the upper surface 30 is removed from the main body 20. At step, 630, toenail polish or other coloring may be applied to the toenails of the wearer of the pedicure protector 10. At step 640, the upper surface 30 may be attached to the main body 20. Although the method is described with reference to the exemplary elements of the systems described above, it should be understood that other implementations are possible.

At step 610, the toes and ball of a wearer's foot is received at a top side 21 of a main body 20. The top side 21 of the main body 20 may comprise a plurality of toe loop separators 50 for wrapping around individual toes to stabilize the foot and reduce and/or inhibit the upward movement of the toes to prevent the toes from coming in contact with the upper surface 30. In this regard, the toe loop separators 50 may reduce the range of flexion of a wearer's toes. In certain embodiments of the invention, two toe loop separators 50 are provided for wrapping around the second and fourth toes of a wearer such that each of the wearer's five toes are separated. In other embodiments of the invention, more or less toe loop separators 50 may be provided. The toe loop separators 50 align and separate toes and fit snugly between and around a wearer's toes. The toe loop separators 50 have a length, diameter and a circumference and may further possess elastic properties. Additionally, the elastic material allows the toe loops to be positioned and maintained at numerous locations between the wearer's toes for customizable positioning between the toes.

When worn by a user, the main body 20 may extend from the ball of the foot to just beyond the toes. The main body 20 and upper surface 30 cover the forefront and base of the toes and form to the foot to hold the toes in place comfortably and without irritation when worn by a user. In addition to the top side 21 for receiving toes and a ball of a foot, the main body 20 may include a bottom side 22, and a perimeter side 23. In certain embodiments of the invention, the bottom side 22 of the main body 20 may be a rough surface, grooved surface, or the like in order to improve traction when used by a wearer (as illustrated, for example, in FIGS. 3 and 5).

At step 620, if an upper surface 30 is attached to the main body 20, the upper surface 30 may be removed from the main body 20. In various embodiments of the invention, the perimeter side 23 of the main body 20 includes one or more attachments 60. The one or more attachments 60 may be affixed to cut out sections 90 in the perimeter side 23 of the main body 20, as illustrated, for example, in FIGS. 1 and 5. The cut out sections 90 may mate with extrusion edges 80 of the upper surface 30 as illustrated, for example, in FIG. 3, having corresponding attachments 40 affixed thereto such that the upper surface 30 is repeatedly detachable and attachable to the perimeter side 23 of the main body 20. The attachments 60 may comprise magnets, hook and loop fasteners, snaps, or any other suitable securing apparatus corresponding to the attachments 40 of the upper surface 30.

At step 630, toenail polish is applied to the toenails of a wearer of the pedicure protector 10. The toenail polish may be more easily applied because the toe loop separators 50 align and separate toes.

At step 640, the upper surface 30 is attached to the main body 20. The upper surface 30 may comprise one or more attachments 40 (as shown, for example, in FIG. 4) for attaching to one or more corresponding attachments 60 of the main body 20. In certain embodiments of the invention, the attachments 40 may be affixed to an inner surface of extrusion edges 80 of the upper surface 30, which mate with the cut out sections 90 of main body 20. The attachments 40 may comprise magnets, hook and loop fasteners, snaps, or any other suitable securing closure or fastener corresponding to the attachments 60 of main body 20.

In various embodiments of the invention, the upper surface 30 may be repeatedly attachable and detachable to the main body 20 and protects recently applied toenail polish from being smudged, smeared or otherwise damaged by coming in contact with other items. The upper surface may comprise a top of foot side 33, a front of foot side 34, an inner foot side 35, and an outer foot side 36, for example. Furthermore, the upper surface 30 may comprise an inner surface 31 and an outer surface 32. The upper surface 30 may also comprise a front section 37 towards the end of a wearer's toes and a back section 38 towards the ball of a wearer's foot. Additionally, the upper surface 30 may comprise extrusion edges 80 that may, in certain embodiments of the invention, extend from front of foot side 34 (as illustrated, for example, in FIG. 1) and/or from one or both of the inner foot side 35 and outer foot side 36 (as illustrated, for example, in FIG. 4-5).

The front of foot side 34, inner foot side 35, and outer foot side 36 of the upper surface 30 may be a sufficient height such that a wearer's flexed toes would not be capable of contacting the inner surface 31 of the top of foot side 33 of the upper surface 30. In an embodiment, the front section 37 of the upper surface 30 may be tapered such that there is more height towards the end of a wearer's toes (i.e., the front of the front section 37) and a lesser height where the front section 37 meets the back section 38 of the upper surface 30 for allowing additional room for a wearer to flex their toes without contacting the inner surface 31 of the upper surface 30. In an embodiment, the back section 38 of the upper surface 30 may be tapered such that there is less height where the front section 37 meets the back section 38 and more height towards the ball of a wearer's foot (i.e., the rear portion of the back section 38) for a comfortable fit to the top of a wearer's foot at the ball of the wearer's foot (as illustrated, for example, in FIGS. 3 and 5).

The upper surface 30 may comprise one or more openings 70, which may, for example, provide ventilation to permit toenail polish to dry. In certain embodiments of the invention, the ventilating holes 70 may be at the back section 38 of the upper surface 30 as illustrated in FIGS. 1-5. For example, the ventilating holes 70 may be just above a point of inflection of a wearer's toes when the upper surface 30 is attached to the main body 20. In another embodiment of the invention, the ventilation holes 70 may be at the front section 37 of the upper surface 30.

In various embodiments of the invention, the pedicure protector 10 may prevent applied toenail polish from smudging, smearing or otherwise being damaged. The pedicure protector 10 may be fabricated utilizing a lightweight foam, foam resin, plastic, or any other suitable lightweight semi-rigid material. The pedicure protector 10 may also be operable to protect applied toenail polish while sleeping and/or while moving about a home. Pedicure protectors 10 may cuff a foot starting from the balls of a foot and moving toward and around the frame of the toes. Pedicure protectors 10 may also provide covering for the ball of a foot and toes. In various embodiments of the invention, a pedicure protector 10 may comprise toe loop separators 50 that may be operable to inhibit upward movement of toes.

In various embodiments of the invention, a pedicure protector 10 is provided that comprises a main body 20 and an upper surface 30 that is repeatedly detachable and attachable to the main body 20. The main body 20 is for receiving the toes and ball of a foot and comprises a plurality of toe loop separators 50 for wrapping around individual toes to align, separate and inhibit upward movement of the toes. The upper surface 30 comprises one or more ventilation holes 70. The upper surface 30 may be more rigid than the main body 20.

The upper surface 30 may comprise a plurality of extrusion edges 80. An inner surface of each of the plurality of extrusion edges 80 may be affixed with at least one attachment 40. The main body 20 may comprise a plurality of cut out sections 90 that correspond with the plurality of extrusion edges 80 of the upper surface 30 when the upper surface 30 is attached to the main body 20. Each of the plurality of cut out sections 90 may be affixed with at least one attachment 60. The at least one attachment 60 may comprise one or more of a magnet, a hook and loop fastener, and a snap.

The upper surface 30 may comprises a front section 37 and a back section 38. The front section 37 of the upper surface 30 may be tapered such that there is more height at a front of the front section 37 and less height where the front section 37 meets the back section 38. The back section 38 of the upper surface may be tapered such that there is less height where the back section 38 meets the front section 37 and more height at a rear portion of the back section 38.

In various embodiments of the invention, the at least one ventilation hole 70 is provided at the back section 38 of the upper surface 30.

The main body 20 may receive toes and the ball of the foot at a top side 21 of the main body 20. Further, a bottom side 22 of the main body 20 may comprises one or more of a rough surface, and a grooved surface. In certain embodiments of the invention, the plurality of toe loop separators 50 each includes a length, diameter, circumference and possesses elastic properties.

In certain embodiments of the invention, the plurality of toe loop separators 50 each includes a length, diameter, circumference and possesses elastic properties.

Various embodiments of the invention provide a method for protecting pedicures. The method may comprise receiving 610 toes and ball of a foot at a top side 21 of a main body 20 of a pedicure protector 10. If an upper surface 30 of the pedicure protector 10 is attached to the main body 20, the method may comprise removing 620 the upper surface 30 from the main body 20. The method may comprise applying 630 toenail polish to toenails of the toes received at the top side 21 of the main body 20 of the pedicure protector 10. The method may comprise attaching 640 the upper surface 30 to the main body 20. The method may comprise wearing the pedicure protector to bed.

In certain embodiments of the invention, the main body 20 of the pedicure protector 10 comprises a plurality of toe loop separators 50 for wrapping around individual toes to align, separate and inhibit upward movement of the toes. The plurality of toe loop separators may each comprise a length, diameter, circumference and possesses elastic properties. The main body 20 comprises a plurality of attachments 60 for attaching to a plurality of corresponding attachments 40 of the upper surface 30.

In certain embodiments of the invention, the upper surface 30 may comprise at least one ventilation hole 70. A bottom side 22 of the main body 20 may comprise one or more of a rough surface and a grooved surface.

While the present invention has been described with reference to certain embodiments, it will be understood by those skilled in the art that various changes may be made and equivalents may be substituted without departing from the scope of the present invention. In addition, many modifications may be made to adapt a particular situation or material to the teachings of the present invention without departing from its scope. Therefore, it is intended that the present invention not be limited to the particular embodiment disclosed, but that the present invention will include all embodiments falling within the scope of the appended claims.

What is claimed is:

1. An apparatus, comprising:

a pedicure protector, the pedicure protector comprising:

a main body sized to extend from a ball of a foot to just beyond toes of the foot, the main body comprising a plurality of toe loop separators for wrapping around individual toes to align, separate and inhibit vertical or horizontal movement of the toes; and an upper surface that is repeatedly detachable and attachable to the main body, wherein the upper surface comprises at least one ventilation hole.

2. The apparatus according to claim 1, wherein the upper surface is more rigid than the main body.

3. The apparatus according to claim 1, wherein the upper surface comprises a plurality of extrusion edges.

4. The apparatus according to claim 3, wherein an inner surface of each of the plurality of extrusion edges is affixed with at least one attachment.

5. The apparatus according to claim 4, wherein the at least one attachment comprises at least one of:

a magnet, a hook and loop fastener, and a snap.

6. The apparatus according to claim 3, wherein the main body comprises a plurality of cut out sections that correspond with the plurality of extrusion edges of the upper surface when the upper surface is attached to the main body.

7. The apparatus according to claim 6, wherein each of the plurality of cut out sections is affixed with at least one attachment.

8. The apparatus according to claim 7, wherein the at least one attachment comprises at least one of:

a magnet, a hook and loop fastener, and a snap.

9. The apparatus according to claim 1, wherein the upper surface comprises a front section and a back section.

10. The apparatus according to claim 9, wherein the front section of the upper surface is tapered such that there is more height at a front of the front section and less height where the front section meets the back section.

11. The apparatus according to claim 9, wherein the back section of the upper surface is tapered such that there is less height where the back section meets the front section and more height at a rear portion of the back section.

12. The apparatus according to claim 9, wherein the at least one ventilation hole is provided at the back section of the upper surface.

13. The apparatus according to claim 1, wherein the main body receives toes and the ball of the foot at a top side of the main body, and a bottom side of the main body comprises at least one of:

a rough surface, and a grooved surface.

14. The apparatus according to claim 1, wherein the plurality of toe loop separators each comprises a length, diameter, circumference and possesses elastic properties.

15. A method for protecting pedicures, the method comprising:

receiving toes and ball of a foot at a top side of a main body of a pedicure protector, the main body sized to extend from the ball to just beyond the toes of the foot;

if an upper surface of the pedicure protector is attached to the main body, removing the upper surface from the main body;

applying toenail polish to toenails of the toes received at the top side of the main body of the pedicure protector; and attaching the upper surface to the main body.

16. The method of claim 15 comprising wearing the pedicure protector to bed.

17. The method of claim 15 wherein the main body of the pedicure protector comprises a plurality of toe loop separators for wrapping around individual toes to align, separate and inhibit upward movement of the toes.

18. The method of claim 17 wherein the plurality of toe loop separators each comprises a length, diameter, circumference and possesses elastic properties.

19. The method of claim 15 wherein the main body comprises a plurality of attachments for attaching to a plurality of corresponding attachments of the upper surface.

20. The method of claim 15 wherein the upper surface comprises at least one ventilation hole.

21. The method of claim 15 wherein a bottom side of the main body comprises at least one of:

a rough surface, and a grooved surface.

* * * * *